United States Patent [19]
Landbeck et al.
[11] Patent Number: 4,470,825
[45] Date of Patent: Sep. 11, 1984

[54] PROCESS FOR THE FAT-LIQUORING OF LEATHERS AND SKINS

[75] Inventors: Fritz Landbeck, Holzergerlingen; Heinz-Peter Matschkal, Gartringen; Paul Rathfelder, Boeblingen; Rolf Leberfinger, Holzgerlingen, all of Fed. Rep. of Germany

[73] Assignee: Schill & Seilacher GmbH & Co., Boeblingen, Fed. Rep. of Germany

[21] Appl. No.: 542,030

[22] Filed: Oct. 14, 1983

[30] Foreign Application Priority Data

Oct. 15, 1982 [DE] Fed. Rep. of Germany ..... 3238180

[51] Int. Cl.[3] ..... C14C 9/02
[52] U.S. Cl. ..... 8/94.23; 8/94.22; 8/94.21; 252/8.57; 252/312; 427/389; 260/403
[58] Field of Search ..... 252/8.57; 8/94.21, 94.22, 8/94.23; 427/389

[56] References Cited

U.S. PATENT DOCUMENTS

| | | | |
|---|---|---|---|
| 3,004,922 | 10/1961 | Buer | 8/94.23 |
| 3,910,972 | 10/1975 | Dieckelmann | 252/8.57 |
| 4,174,296 | 11/1979 | Kass | 260/403 |
| 4,200,551 | 4/1980 | Orthoefer | 260/403 |
| 4,281,997 | 8/1981 | Rosenbusch et al. | 8/94.23 |

FOREIGN PATENT DOCUMENTS

| | | | |
|---|---|---|---|
| 2843755 | 4/1979 | Fed. Rep. of Germany . | |
| 2258453 | 9/1975 | France | 8/94.1 R |

*Primary Examiner*—Maria Parrish Tungol
*Attorney, Agent, or Firm*—Schwartz, Jeffery, Schwaab, Mack, Blumenthal & Koch

[57] ABSTRACT

Self-emulsifying lecithin salts are used for the fat-liquoring of leathers and skins. They are obtained by the partial or complete neutralization of industrial lecithins obtained from vegetable oils (acid numbers 10 to 40) with ethoxylated fatty amines.

6 Claims, No Drawings

PROCESS FOR THE FAT-LIQUORING OF LEATHERS AND SKINS

BACKGROUND OF THE INVENTION

Lecithins have been known for many years as valuable agents for the fat-liquoring of leather. For use in fat-liquoring baths, lecithins are emulsified with known anionic, cationic, or nonionic emulsifiers. Frequently, anionic, cationic, and nonionic leather oils are used in combination with lecithins.

In a series of German patents, agents for the fat-liquoring of leather are described. The agents cited consist of a mixture of lecithins and fatty oils or fish oil. In certain patents of addition, the variation of agents resides in the addition to the mixture of a multiple amount of water or slight quantities of soaps or sulfonated oil. The aforementioned agents are described in detail in the principal patent DE-PS No. 514 399 and in the corresponding patents of addition DE-PS No. 516 187, DE-PS No. 516 188, DE-PS No. 516 189 and DE-PS No. 522 041.

In DE-OS No. 31 01 914, partially saponified lecithins having a saponification number of 120–140 are disclosed in admixture with polyhydroxyl compounds (sugar and the like) as auxiliary agents for textiles, paper, and leather, used particularly in formulations containing nonionic or anion active emulsifiers, and also with organic solvents.

It is further proposed in DE-AS No. 28 43 755 to use a hydroxylated phosphatide for the fat-liquoring of tanned leather.

The above cited patents indicate that lecithin, in view of its chemical structure (it consists of a fatty substance with polar groups), is a readily applicable leather fat-liquoring agent. Experience shows, however, that in emulsions it forms large micelles, so that its penetration into the leather is incomplete. The use of lecithin is therefore restricted in actual practice, as frequently the leather is inadequately oiled and the finished leathers are stiff and excessively hard.

The essential condition of the use of lecithin is to employ a formulation whereby the leather is penetrated completely and uniformly by the fat-liquoring agent and the liquor bath is depleted efficiently and as completely as possible.

SUMMARY OF THE INVENTION

It is therefore an object of the present invention to provide a method for fat-liquoring leather and skins whereby the fat-liquoring agent is uniformly absorbed and the treated material is completely penetrated.

It is another object of the present invention to provide a process for using self-emulsifying conversion products of industrial lecithins to obtain finished leather and skins of exceptional softness and texture.

In accomplishing the foregoing objects, there has been provided, in accordance with one aspect of the present invention, a method for achieving the uniform absorption of fat by leather or skins from an aqueous emulsion, comprising the step of treating leather and skins in a fat-liquor bath containing self-emulsifying lecithin salts obtained by at least partial neutralization of industrial lecithins with an ethoxylated fatty amine, preferably where the industrial lecithins are only partially neutralized.

Other objects, features, and attendant advantages of the present invention will become readily apparent from the following detailed description of preferred embodiments and illstrative examples.

DETAILED DESCRIPTION OF PREFERRED EMBODIMENTS

It has now been discovered that good, uniform absorption by the leather of lecithin from an aqueous emulsion can be obtained in a simple manner, if lecithin is used in the form of self-emulsifying salts, which are obtained by the neutralization of industrial lecithins (generally having acid numbers of 10 to 40) with ethoxylated fatty amines.

The abovementioned salts may be used as additions to the usual fat-liquoring agents or as the only fat-liquoring agents. Even with a relatively low quantity of available oil, extremely soft, solidly grained and smooth leathers are obtained.

In the preparation of the lecithin salts used according to the claimed invention, industrial lecithins obtained from vegetable oils (for example, soy bean oil, rapeseed oil, corn oil), having acid numbers between about 10 and about 40, preferably 15 and 30, and having been neutralized completely or partially with ethoxylated fatty amines, are used. The lecithins contain, in addition to phosphatides, mainly fats (triglycerides) in a concentration generally around 30–40% by weight.

Oxethylated fatty amines used in the present invention have a saturated or unsaturated, straight or branched carbon chain of 8 to 24 carbon atoms, preferably 12–18 carbon atoms, and an oxethylation degree of from about 5–30 moles of ethylene oxide per mole of fatty amine, preferably 15–25.

To prepare a leather fat-liquoring agent according to the invention, the two components of lecithin and the fatty amine ethoxylate are homogeneously mixed at a temperature higher than the melting point of the individual components and eventually cooled to room temperature, if necessary.

In the process according to the present invention, for 1 gram of lecithin, 0.18–0.71 m mole of ethoxylated fatty amine is used to achieve complete neutralization of lecithin having an acid number of 10 to 40. Preferably, partial neutralization is effected, for which 30–50% of the ethoxylated fatty amine to effect complete neutralization is used. In parts by weight, this means that, for complete neutralization of 10 parts of lecithin, 0.6–12 parts by weight of ethoxylated fatty amine are used, depending on the acid number of the lecithin and the molecular weight of the ethoxylated fatty amine. In actual practice, 1–3 parts by weight of the ethoxylated fatty amine per 10 parts by weight of the lecithin are preferably employed for partial neutralization.

For use in the fat-liquor, the neutralization product of lecithin, according to the invention, is preemulsified with water in the conventional manner and then added to the fat-liquor bath in the barrel.

EXAMPLE I 1000 parts by weight of a commercial, industrial soy bean lecithin with an acid number of 20 are mixed homogeneously at 50° C. with 150 parts by weight of an oleylamino-oxyethylate with 20 moles ethylene oxide for partial neutralization.

Neutralized chrome cowhide retanned with mimosa is treated in the fat-liquor bath with 7% (relative to the shaved weight) of the neutralization product. For this purpose —is customary in actual practice —the fat-liquoring as agent is pre-emulsified with warm water and then added to the fat-liquor bath. During a processing period of 60 minutes, the fat is completely absorbed by the leather. The leathers are then further processed in the conventional manner. The finished leathers are extraordinarily soft and show a fine, smooth, solid grain.

EXAMPLE 2

1000 parts of a commercially available, industrial soy bean lecithin with an acid number of 30 are homogeneously mixed 50° C. with 200 parts of an oleylaminoethoxylate with 20 mole ethylene oxide for partial homogeneization.

(a) Pickled sheep skins are chrome tanned in a conventional manner and during the tanning process treated in the same liquor with 8 g of the neutralization product per liter of liquor. For this purpose, the fat-liquoring agent is pre-emulsified and added to the chrome tanning bath. After a running time of 12 hours the bath no longer contains any fat, i.e., the fat has been completely absorbed by the leather. The skins are then further processed in a conventional manner. The finished skins are extraordinarily soft and have a smooth feel.

(b) Chrome tanned sheep skins are neutralized following the tanning in fresh liquor and fat-liquored in the same bath with 7 g of the neutralization product per liter of the liquor. The fat-liquoring agent is pre-emulsified and added to the liquor. During a running time of 60 min. the fat is completely absorbed by the leather. The leathers are further processed in the conventional manner and are very soft and light.

EXAMPLE 3

1000 parts of a commercial, industrial soy bean lecithin with an acid number of 30 are homogeneously mixed at 40° C. with 150 parts of a coconut oil amine with 15 moles ethylene oxide for partial neutralization. After cooling to 20° C., the neutralized product may be used as a fat-liquor bath. Retanned and neutralized sheep skin is treated in the fat-liquoring bath with 10% of the neutralization product (with respect to the shaved weight). The neutralized product is first emulsified with warm water and then added to the fat-liquor bath. During a process time of 40–60 min the fat is completely absorbed by the leather. The leathers are further processed in a conventional manner. The finished nappa leathers are extraordinarily tear resistant and have a soft and light feel.

What is claimed is:

1. A method for achieving the uniform absorption of fat by leather or skins from an aequeous emulsion, comprising the step of treating leather or a skin in a fat-liquor bath containg self-emulsifying lecithin salts obtained by at least partial neutralization of industrial lecithins with an ethoxylated fatty amine.

2. A method as in claim 1, wherein said industrial lecithins have an acid number in the range of about 15 to 30.

3. A method as in claim 1, wherein said neutralization of said industrial lecithins is partial.

4. A method as in claim 3, wherein 1 to 3 parts by weight of said ethoxylated fatty amine per 10 parts by weight of said industrial lecithin are used for said neutralization.

5. A method according to claim 1, wherein said ethoxylated fatty amines contain 8 to 24 carbon atoms and between 5 and 30 moles of ethylene oxide per mole of fatty amine.

6. A method as in claim 5, wherein said ethoxylated fatty amines contain 12 to 18 carbon atoms and between 15 and 25 moles of ethylene oxide per mole of fatty amine.

* * * * *